US006232718B1

(12) United States Patent
Johnston et al.

(10) Patent No.: US 6,232,718 B1
(45) Date of Patent: May 15, 2001

(54) CERAMIC FEEDTHROUGHS FOR DISCHARGE LAMPS

(75) Inventors: David W. Johnston, Amesbury; Joseph A. Olsen, Rockport, both of MA (US)

(73) Assignee: Osray Sylvania Inc., Danvers, MA (US)

( * ) Notice: Subject to any disclaimer, the term of this patent is extended or adjusted under 35 U.S.C. 154(b) by 0 days.

(21) Appl. No.: 09/260,103

(22) Filed: Mar. 2, 1999

(51) Int. Cl.[7] ..... H01J 17/18
(52) U.S. Cl. ..... 313/623; 313/574; 313/607
(58) Field of Search ..... 313/626, 379, 313/623, 583, 66, 567, 574, 607, 608

(56) References Cited

U.S. PATENT DOCUMENTS 5,424,608 * 6/1995 Juengst et al. ..... 313/623

FOREIGN PATENT DOCUMENTS 64-63255 * 3/1989 (JP) ..... H01J/61/067

* cited by examiner

*Primary Examiner*—Vip Patel
*Assistant Examiner*—Karabi Guharay
(74) *Attorney, Agent, or Firm*—William H. Mc Neill

(57) ABSTRACT

An arc discharge lamp body made from a material selected from glass and ceramic materials and defining a discharge space; an arc generating and sustaining medium contained within said discharge space; and an electrically conducting member in at least one end of said body and extending both interiorly and exteriorly thereof, said electrically conducting member being formed of an electrically conductive ceramic material having a thermal coefficient of expansion substantially matching that of said body.

3 Claims, 1 Drawing Sheet

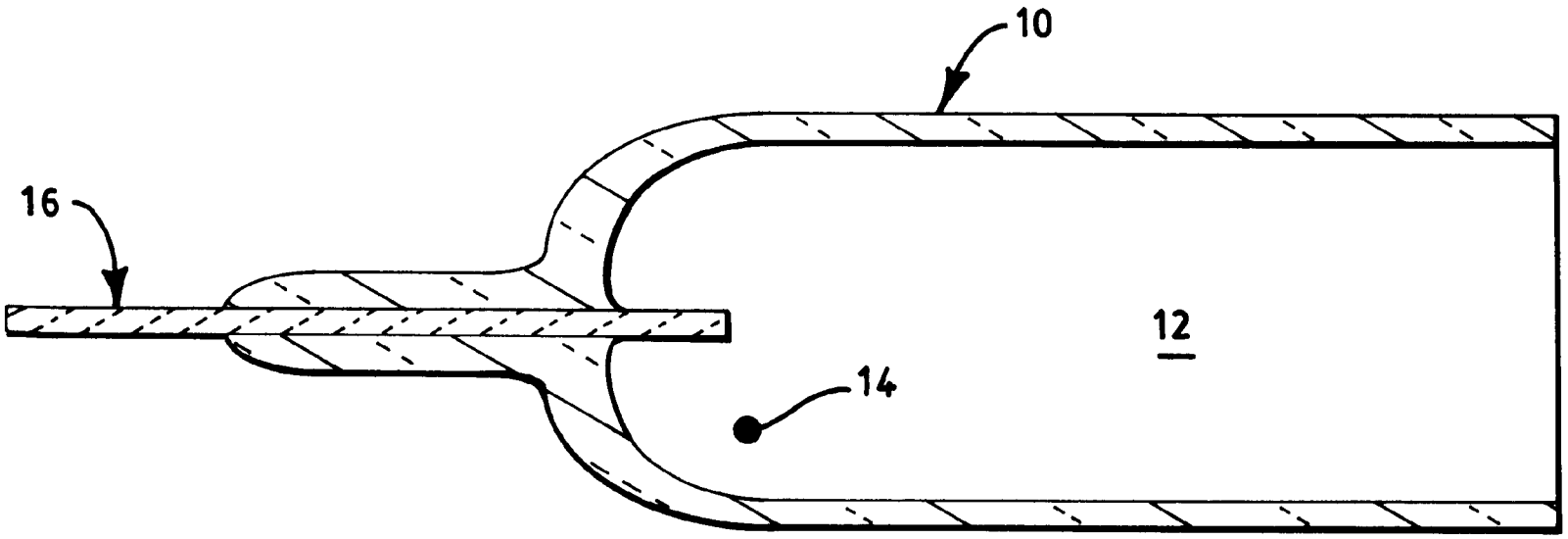
10
12
14
16

CERAMIC FEEDTHROUGHS FOR DISCHARGE LAMPS

TECHNICAL FIELD

The invention relates to arc discharge lamps and more particularly to such lamps having electrically conducting ceramic feedthroughs serving as electrodes.

BACKGROUND ART

Arc discharge lamps, such as high and low pressure sodium, mercury and metal halide types, have a glass or ceramic hollow body containing therewithin an arc discharge generating and sustaining medium. Such mediums usually contain one or more metallic elements and one or more gases, as is well known in the art. Electrical current is supplied to the lamp via metal electrodes hermetically sealed in the lamp body. While this approach has worked for many years problems arise when the components of the lamp fill, or the operating temperature of the lamps, degrade the metal feedthroughs and shorten the expected lamp life. Additional problems can arise because the never quite perfect match of thermal expansion coefficients between the lamp body and the metal feedthroughs will eventually cause the lamp body or envelope to rupture.

DISCLOSURE OF INVENTION

It is, therefore, an object of the invention to obviate the disadvantages of the prior art.

It is another object of the invention to enhance the sealing capabilities of discharge lamps.

Yet another object of the invention is the provision of ceramic feedthroughs for arc discharge lamps.

These objects are accomplished, in one aspect of the invention, by an arc discharge lamp body made from a material selected from glass and ceramic materials and defining a discharge space; an arc generating and sustaining medium contained within the discharge space; and an electrically conducting member in at least one end of the body and extending both interiorly and exteriorly thereof, the electrically conducting member being formed of an electrically conductive ceramic material having a thermal coefficient of expansion substantially matching that of the lamp body.

BRIEF DESCRIPTION OF THE DRAWINGS

The single FIGURE illustrates an embodiment of the invention.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Referring now to the drawing with greater particularity, there is shown, partially in section, an arc discharge lamp body 10 defining a discharge space 12 and containing an arc generating and sustaining medium, diagrammatically shown as 14. An electrically conducting member 16 is sealed into at least one end of the body 10 and extends both interiorly and exteriorly of the body. Electrically conducting member 16 is formed of an electrically conducting ceramic material having a coefficient of thermal expansion matching that of the body.

In a preferred embodiment of the invention, a body 10 was formed from No. 7052 glass, a known material generally employed for sealing to Kovar. The material comprises, in percentages by weight (wt.), $SiO_2$ 65%; $Al_2O_3$ 7%, $B_2O_3$ 18%, $Li_2O$ 1%, $Na_2O$ 2%, $K_2O$ 3% and BaO 3%+$F^-$. The electrically conductive ceramic 16 was formed from C5544 TN3, a material available from Osram Sylvania Inc. in Towanda, Pa. This material comprises about, in wt. %, 60% TiN, 1.6% AlN, 2.3% $Y_2O_3$, 1.1% $Al_2O_3$, and the balance $Si_3N_4$.

Additionally, bodies were formed with the same electrically conductive ceramic and an aluminosilicate glass (Corning 1724). While the thermal expansion mismatch was higher, leading to some cracks, the operating temperature of a lamp made with such bodies can be increased by >100° C.

In tests with these bodies filled with argon and a standard tungsten electrode in the other end, and arc was struck, clearly demonstrating the workability of the ceramic electrode. In the test device, the ceramic feedthrough acted as a cathode, even though the material is not known to have a low work function.

Other electrically conductive ceramic compositions can be utilized with other glasses. In designing other combinations for sealing purposes it is important to measure the electrical conductivity of the ceramic material, the thermal expansion behavior of the ceramic material and its chemical stability in the lamp environment. A suitable glass can be chosen by matching the glass and ceramic expansion properties up to a temperature corresponding to the strain point of the glass. The cross-sectional size of the ceramic electrode should be kept as small as possible considering the current carrying capacity of the material.

While there have been shown and described what are at present considered the preferred embodiments of the invention, it will be apparent to those skilled in the art that various changes and modifications can be made herein without departing from the scope of the invention as defined by the appended claims.

What is claimed is:

1. An arc discharge lamp body made from ceramic materials and defining a discharge space; an arc generating and sustaining medium contained within said discharge space; and an electrically conducting member in at least one end of said body and extending both interiorly and exteriorly thereof, said electrically conducting member being formed of an electrically conductive ceramic material having a thermal coefficient of expansion substantially matching that of said body, said electrically conducting member being formed substantially of titanium nitride and silicon nitride.

2. The lamp body of claim 1 wherein said titanium nitride and said silicon nitride comprises about 95 wt. % of said electrically conducting member.

3. The lamp body of claim 1 wherein said electrically conducting member comprises about 60 wt. % titanium nitride, about 1.6 wt. % aluminum nitride, about 2.3 wt. % yttrium oxide, about 1.1 wt. % aluminum oxide and the balance silicon nitride.

* * * * *